United States Patent [19]

Mowbray

[11] 4,186,884

[45] Feb. 5, 1980

[54] LIQUID FUEL INJECTION NOZZLES

[75] Inventor: Dorian F. Mowbray, Burnham, England

[73] Assignee: Lucas Industries Limited, Birmingham, England

[21] Appl. No.: 968,929

[22] Filed: Dec. 13, 1978

[30] Foreign Application Priority Data

Jan. 11, 1978 [GB] United Kingdom ..... 991/78

[51] Int. Cl.[2] ..... F02M 47/02

[52] U.S. Cl. ..... 239/533.8

[58] Field of Search ..... 239/533.3, 533.4, 533.5, 239/533.6, 533.7, 533.8, 533.9, 533.11, 533.12, 124

[56] References Cited

U.S. PATENT DOCUMENTS

| | | | |
|---|---|---|---|
| 2,595,639 | 5/1952 | Chmura et al. | 239/533.3 |
| 3,797,753 | 3/1974 | Fenne et al. | 239/533.8 |
| 3,831,863 | 8/1974 | Fenne | 239/533.8 |
| 3,910,503 | 10/1975 | Barber | 239/533.8 |

*Primary Examiner*—John J. Love

*Assistant Examiner*—Michael J. Forman

[57] ABSTRACT

A fuel injection nozzle has a valve member biased to the closed position by a spring and a piston housed in a bore connected to the inlet of the nozzle by way of a non-return valve. A space between the piston and valve member is vented to a drain. In order to minimize leakage of fuel, the piston and the bore in which it is located define a groove which is connected to the fuel inlet so that any fuel leaking from the end of the piston subjected to the pressure of fuel at the inlet collects in the groove and returns to the inlet when the pressure of fuel at the inlet falls.

4 Claims, 4 Drawing Figures

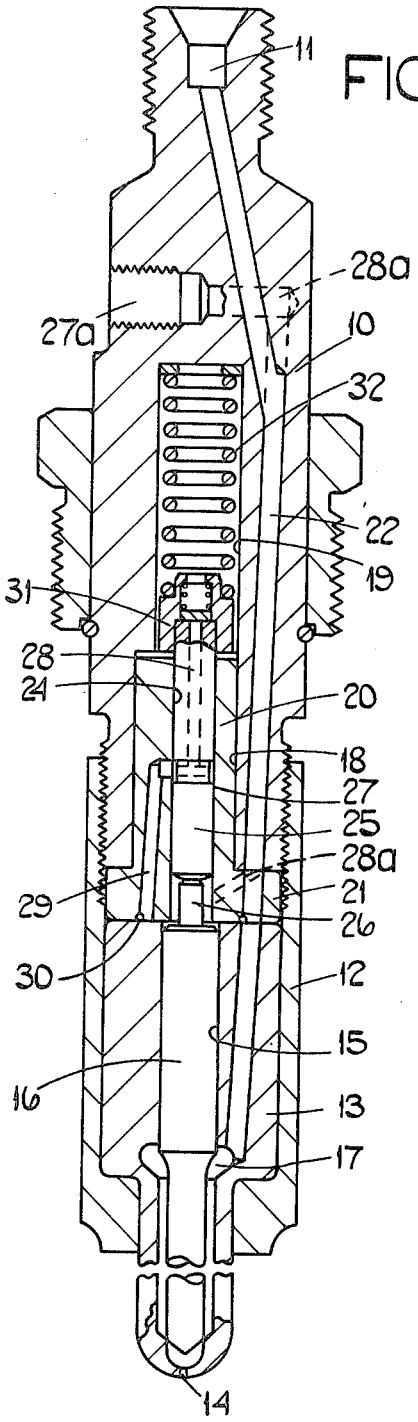
FIG.1.
FIG.2.
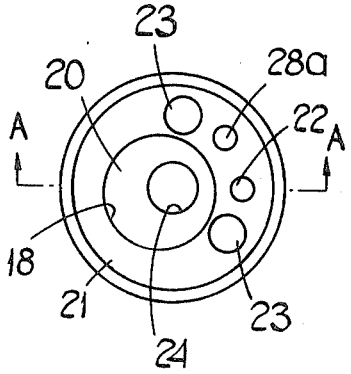
FIG.3.
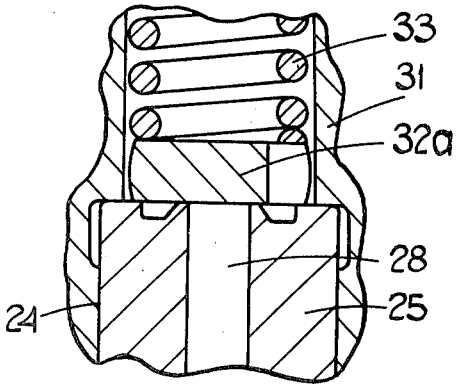
FIG.4.
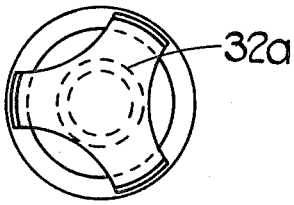

LIQUID FUEL INJECTION NOZZLES

This invention relates to a liquid fuel injection nozzle for an internal combustion engine and of the kind comprising a fluid pressure operable resiliently loaded valve member for controlling the flow of fuel through an outlet orifice from an inlet, the inlet in use, being connected to a fuel pump actuated by the engine, the fuel pressure at the inlet acting on a surface defined on the valve member to lift the valve member and thereby to permit fuel flow through the outlet orifice, a cylinder, a piston slidable in said cylinder and having a smaller cross-sectional area than said surface of the valve member, a conduit through which in use fuel can be supplied to one end of said cylinder at a pressure substantially the same as the pressure of fuel supplied to said inlet, a non-return valve in said conduit and acting to prevent flow of fuel out of said end of cylinder through the conduit and means coupling the piston and the valve member so that the force developed on said piston due to the fuel pressure acting thereon is applied to the valve member to assist the action of the resilient means loading the valve member, the closing force exerted on the valve member increasing as the pressure of fuel supplied to the inlet increases.

Such a nozzle is described in the specification of British Pat. No. 1412413. In the two examples described in the aforesaid specification the piston is slidable within a cylinder formed in the body part of the nozzle, the valve member being located in a nozzle head secured to the body by a cap nut. The means which couples the piston to the valve member is located in a space which is vented to a drain. The conduit is formed in the body part and leads directly into the cylinder and any fuel which leaks past the piston flows into the aforesaid space and to the drain. The leakage of fuel from the cylinder takes place all the time the nozzle is in use so that there can be an appreciable loss of fuel. In addition, and this applies to the example shown in FIG. 2 of the aforesaid specification, it has been found that the clamping force developed between the body and head causes distortion of the body to the extent that the piston can stick within the cylinder. Moreover, since the cylinder is formed directly in the valve body when the nozzle is required to have a different operating characteristic the body and the piston must both be changed.

The object of the invention is to provide a fuel injection nozzle of the kind specified in a simple and convenient form.

According to the invention in a fuel injection nozzle of the kind specified, said cylinder is defined in a flanged insert which extends within a bore defined in the nozzle body, the flanged portion of said insert being clamped between the nozzle body and the nozzle head, the piston being located in said cylinder and extending into a portion of said bore remote from the nozzle head, the cylinder and piston defining an annular groove forming part of said conduit, a further part of said conduit being formed by a drilling in the piston which extends between said groove and said portion of the bore, said non-return valve being disposed in said further part of the conduit whereby fuel leaking past the said piston from said portion of the bore is collected in said groove and returned to said inlet.

According to a further feature of the invention said non-return valve comprises a spring loaded plate valve co-operating with the end of the piston within said portion of the bore.

According to a further feature of the invention the flange is disposed at the end of the insert and the piston extends within said cyliner to a position spaced from the end of the cylinder adjacent the nozzle head by an amount substantially equal to the width of the flange.

According to a still further feature of the invention said bore is formed in two parts, the first of which is adjacent the nozzle head and has a larger diameter than the second part and has its axis off set relative to the axis of the valve member, the insert being located in said first part with the axis of the cylinder aligned with the axis of the valve member and a part of said conduit being formed in the wider portion of the insert.

One example of a fuel injection nozzle in accordance with the invention will now be described with reference to the accompanying drawings in which:

FIG. 1 is a sectional side elevation of the nozzle on the line AA of FIG. 2,

FIG. 2 is a plan view of part of the nozzle shown im FIG. 1 removed from the nozzle body, FIG. 3 is an enlarged sectional view of a portion of the nozzle seen in FIG. 1 and FIG. 4 is a plan view to the scale of FIG. 3 and shows a plan view of two components shown in FIG. 3.

Referring to FIG. 1 of the drawings the fuel injection nozzle comprises a nozzle body 10 which is of generally cylindrical form and which at one end is of reduced diameter and is provided with a peripheral screw thread to enable a conduit to be connected thereto. This end of the nozzle defines an inlet 11 which in use is connected by the aforesaid conduit to a fuel injection pump.

At the other end of the body there is also provided a peripheral screw thread for engagement by a cap nut 12 which acts to retain a nozzle head 13 in assembly with the body 10. The nozzle head 13 has a reduced portion which extends through an aperture in the cap nut and the end of the reduced portion defines an outlet orifice 14 through which in use, fuel flows to a combustion space of the engine.

Formed in the nozzle head is a bore 15 which accommodates a valve member 16. The end of the valve member remote from the body is of conical form and co-operates with a seating to control the flow of fuel through the outlet 14. Formed in the bore 15 is a circumferential groove 17 and the portion of the valve member between the groove 17 and the outlet 14 is of reduced diameter to define an annular space through which liquid fuel can flow to the outlet 14 when the valve member is lifted from its seating.

The nozzle body is also provided with a bore which extends from the face of the body presented to the nozzle head. The bore is formed in two parts the first of which is referenced 18, has its axis off-set from the longitudinal axis of the valve member 16. The second part referenced 19, of the bore is of smaller diameter than the part 18 and has its axis aligned with the longitudinal axis of the valve member. Located within the part 18 of the bore is a cylindrical insert 20 which at its end directed to the nozzle head, is provided with a flange 21. The flange 21 is clamped between the presented faces of the nozzle body and the nozzle head. A passage 22 extends between the inlet 11 and the annular groove 17 the passage passing through the nozzle body, the flange and the nozzle head. Moreover, in order to accurately align the insert and the nozzle body, a pair of dowels 23 are provided between the flange and the nozzle body.

Formed in the insert is a cylinder 24, the axis of the cylinder being aligned with the longitudinal axis of the valve member. Located in the cylinder is a piston 25. The piston 25 is engageable with an extension 26 of the valve member 16, the extension being located within the bore 24 but being of reduced diameter. The resulting annular space is vented to a drain outlet 27*a* by means of a passage 28*a* extending within the body and the flange The passage 28*a* is shown in dotted outline in FIG. 1. Moreover, the extension 26 extends within the bore 24 so that the end of the piston 25 which engages the extension 26 is spaced from the end of the cylinder 24 by an amount substantially equal to the width of the flange 21. The end portion of the cylinder 24 is slightly enlarged to define said space whereby when the cap nut is tightened any distortion of the flange will not result in distortion of that part of the cylinder in which the piston slides.

Intermediate the ends of the piston there is formed a circumferential groove 27 which communicates with a drilling 28 formed in the piston and extending to the end of the piston 25 which is located in the part 19 of the bore. The groove 27 communicates by way of a passage 29 formed in the cylindrical portion of the insert, and an annular groove 30 formed in the face of the flange, which is presented to the nozzle head, with the passage 22. The groove 30, passage 29 and drilling 28 form a conduit connecting the inlet 11 with the part 19 of the bore whereby fuel at inlet pressure can act on the piston to load the valve member 16 into contact with its seating.

The area of the piston 25 which is exposed to the inlet pressure is less than the area of the valve member 16 which is exposed to the same inlet pressure.

Mounted on the portion of the piston 25 which projects into the part 19 of the bore, is an abutment 31 for a coiled compression spring 32. The compression spring 32 acts through the piston 25 to load the valve member 16 onto the seating.

Moreover, the abutment 31 houses part of a non-return valve and as shown in FIG. 3, the valve comprises a plate 32*a* which is loaded by means of a coiled compression spring 33, into contact with the end of the piston 25. The end surfaces of the piston 25 forms a seating surface for the plate 32*a* and thereby constitutes a non-return valve. As seen in FIG. 4, the plate 32*a* has cut out portions about its periphery, so that when the plate is lifted from the piston by the action of fuel under pressure, the fuel can flow into the part 19 of the bore.

In operation, when fuel under pressure is supplied to the inlet 11 the pressure of fuel acts on the valve member 16 in a direction to lift it from its seating thereby to allow fuel flow through the outlet 14. In addition, fuel under pressure flows through the groove 30, passage 29 and drilling 28 by way of the non-return valve into the portion 19 of the bore. The force developed on the piston therefore opposes the force tending to lift the valve member from its seating and assists the spring 32 in retaining the valve member on the seating. As the pressure increases, however, a point will be reached at which the opening force developed on the valve member is greater than the closing force exerted thereon and the valve member will lift from the seating to allow fuel flow as described.

In use, the pressure in the upper part of the bore 19 will be maintained at the peak injection pressure and fuel will leak from the part 19 of the bore along the working clearance defined between the piston and the cylinder. This fuel will however, be collected in the annular groove 27 and will be returned to the inlet 11 during the periods when the pressure at the inlet 11 falls that is to say when the delivery of fuel from the fuel pump has ceased. This fuel is therefore not wasted in the sense of being lost to a drain. Fuel leakage will occur along that portion of the working clearance defined between the annular groove 27 and the aforesaid space and in addition fuel leaking between the valve member 16 and the bore 15 will flow into the annular space. This flow only takes place when the pressure at the inlet 11 is high and by adopting the construction described above there is a saving in the quantity of fuel which leaks as compared with the injection nozzles described in the aforesaid British Patent specification.

I claim:

1. A liquid fuel injection nozzle for an internal combustion engine comprising a nozzle body and a nozzle head adapted to be connected together, a fluid pressure operable resiliently loaded valve member for controlling the flow of fuel through an outlet orifice from an inlet, the inlet in use, being connected to a fuel pump actuated by the engine, the fuel pressure at the inlet acting on a surface defined on the valve member to lift the valve member and thereby to permit fuel flow through the outlet orifice, a cylinder, a piston slidable in said cylinder and having a smaller cross-sectional area than said surface of the valve member, a conduit through which in use fuel can be supplied to one end of said cylinder at a pressure substantially the same as the pressure of fuel supplied to said inlet, a non-return valve in said conduit and acting to prevent flow of fuel out of said end of said cylinder through the conduit and means coupling the piston and the valve member so that the force developed on said piston due to the fuel pressure acting thereon is applied to the valve member to assist the action of the resilient means loading the valve member, the closing force exerted on the valve member increasing as the pressure of fuel supplied to the inlet increases, said cylinder being defined in a flanged insert which extends within a bore defined in the nozzle body, the flanged portion of said insert being clamped between the nozzle body and the nozzle head, the piston being located in said cylinder and extending into a portion of said bore remote from the nozzle head, the cylinder and piston defining an annular groove forming part of said conduit, a further part of said conduit being formed by a drilling in the piston which extends between said groove and said portion of the bore, said non-return valve being disposed in said further part of the conduit whereby fuel leaking past the said piston from said portion of the bore is collected in said groove and returned to said inlet.

2. A nozzle according to claim 1 in which the flange is disposed at the end of the insert and the piston extends within said cylinder to a position spaced from the end of the cylinder adjacent the nozzle head by an amount substantially equal to the width of the flange.

3. A nozzle according to claim 1 or claim 2 in which the non-return valve comprises a spring loaded plate valve co-operating with the end of the piston within said portion of the bore.

4. A nozzle according to claim 1 or claim 2 in which said bore is formed in two parts, the first of which is adjacent the nozzle head and has a larger diameter than the second part and has its longitudinal axis off set relative to the longitudinal axis of the valve member, the insert being located in said first part with the axis of the cylinder aligned with the axis of the valve member and a part of said conduit being formed in the wider portion of the insert.

* * * * *